US009810514B2

(12) United States Patent
Hofer et al.

(10) Patent No.: US 9,810,514 B2
(45) Date of Patent: Nov. 7, 2017

(54) AMMUNITION CARRIER CONSUMER PACKAGE

(71) Applicant: DEUFOL SUNMAN INC., Sunman, IN (US)

(72) Inventors: Dustin Hofer, Brookville, IN (US); Daniel Wyss, Harrison, OH (US)

(73) Assignee: DEUFOL SUNMAN INC., Sunman, IN (US)

( * ) Notice: Subject to any disclaimer, the term of this patent is extended or adjusted under 35 U.S.C. 154(b) by 0 days.

(21) Appl. No.: 15/259,488

(22) Filed: Sep. 8, 2016

(65) Prior Publication Data

US 2017/0067727 A1 Mar. 9, 2017

Related U.S. Application Data

(60) Provisional application No. 62/215,432, filed on Sep. 8, 2015.

(51) Int. Cl.

| | |
|---|---|
| ***F42B 39/26*** | (2006.01) |
| ***B65D 21/02*** | (2006.01) |
| ***B65D 1/36*** | (2006.01) |

(52) U.S. Cl.

CPC ..... *F42B 39/26* (2013.01); *B65D 1/36* (2013.01); *B65D 21/0209* (2013.01)

(58) Field of Classification Search

CPC ..... B65D 1/36; B65D 21/0209; F42B 39/26
USPC ..... 206/3, 523, 593, 461, 470, 521.8, 317; 220/508, 521
See application file for complete search history.

(56) References Cited

U.S. PATENT DOCUMENTS

| | | | | | |
|---|---|---|---|---|---|
| 2,591,471 | A * | 4/1952 | Schwertfeger | B65D 85/324 | 206/521.1 |
| 3,568,915 | A * | 3/1971 | Newman | B65D 85/324 | 206/521.1 |
| 3,580,480 | A * | 5/1971 | French | B65D 85/324 | 206/521.1 |
| 3,933,296 | A * | 1/1976 | Ruskin | B65D 75/245 | 206/541 |
| 3,963,172 | A * | 6/1976 | Holzwarth | B65D 85/324 | 206/521.1 |
| 4,057,188 | A * | 11/1977 | Steinhardt | B29C 51/00 | 206/521.1 |
| 4,884,718 | A * | 12/1989 | Leahy | B65D 43/162 | 206/470 |
| 5,060,814 | A * | 10/1991 | Oglesbee | B65D 43/162 | 206/470 |
| 5,695,062 | A * | 12/1997 | Lemaire | B65B 7/26 | 206/521.1 |
| 6,012,580 | A * | 1/2000 | Peters | B65D 75/58 | 206/438 |

(Continued)

*Primary Examiner* — Chun Cheung
(74) *Attorney, Agent, or Firm* — Thompson Hine LLP

(57) ABSTRACT

A reusable container for storing ammunition cartridges or similar shaped products comprises a base having a plurality of recesses, a first cover portion, and a second cover portion. A first link is pivotably connected to the base and the first cover portion. A second link is pivotably connected to the base and to the second cover portion. In a closed position, a first snap releasably retains the first cover portion over the base and a second snap releasably retains the second cover portion over the base. In an open position, the top and bottom surfaces of the container are configured so that multiple containers can be nested and stacked together.

12 Claims, 7 Drawing Sheets

(56) References Cited

U.S. PATENT DOCUMENTS

| | | | | |
|---|---|---|---|---|
| 7,975,849 | B2 * | 7/2011 | Kim | B65D 43/162 206/1.5 |
| 8,069,983 | B2 * | 12/2011 | Cross | B27B 5/29 206/303 |
| 9,038,817 | B2 | 5/2015 | Connolly et al. | |
| 2013/0118922 | A1 | 5/2013 | McClaughry et al. | |
| 2015/0225136 | A1 * | 8/2015 | Weisshaupt | A61L 2/26 220/200 |

* cited by examiner

SECTION A-A

AMMUNITION CARRIER CONSUMER PACKAGE

PRIORITY CLAIM

This application claims priority from U.S. Provisional Application 62/215,432, filed Sep. 8, 2015.

TECHNICAL FIELD

This application relates generally to improvements in packaging ammunition or similar shaped products and, more specifically, to a package that protects its contents, can be used for multiple quantities, and is re-useable after it is initially opened.

BACKGROUND

Packaging for the storage and shipping of ammunition has not been consumer friendly—either because it does not adequately protect the contents, does not provide easy access to the contents for removal or reinsertion, or because it is not re-usable once opened.

It would be desirable to provide a package for ammunition or similar shaped products that allows a consumer to open the package, easily remove a desired quantity of the contents, and reseal the package to protect the remaining contents from exposure and damage. Preferably the package would hold a consumer-friendly quantity of units, such as 25, so that larger quantities are not opened for exposure to outside elements before they are needed. It would also be desirable for the package to be inexpensive to manufacture and ship in large quantities.

SUMMARY

A firearm cartridge storage container is disclosed that includes a base, a first cover portion, and a second cover portion. The base includes a plurality of recesses that are configured to receive an item for storage such as a firearm cartridge. The first and second cover portions are pivotable between open and closed positions by means of first and second links, respectively. First and second snaps releasably retain the first and second cover portions, respectively, in the closed position over the base.

According to a second aspect, a plastic tray is disclosed that is configured to be folded into a container. The tray comprises a first end segment, a first link, a middle segment, a second link, and a second end segment. The top sides of the first end segment, middle segment, and second end segment, each have a plurality of recesses therein. The first link is pivotably connected at a first end to the first end segment and is pivotably connected at a second end to the middle segment. The second link is pivotably connected at a first end to the middle segment and is pivotably connected at a second end to the second end segment. By means of the first and second links, respectively, the first and second end segments are pivotable to a position over the middle segment such that the top sides of the first and second end segments face and are adjacent to the top side of the middle segment.

According to a third aspect, a nested stack of plastic trays is disclosed. Each tray is identical and comprises a first end segment having a plurality recesses, a first link pivotably connected to the first end segment, a middle segment having a plurality of recesses and pivotably connected to the first link, a second link pivotably connected to the middle segment, and a second end segment having a plurality of recesses and pivotably connected to the second link. The top surface of each tray is configured to fit within the bottom surface of another tray such that a plurality of trays can be nested together and stacked for easy shipment and packaging in large quantities.

The details of one or more embodiments are set forth in the accompanying drawings and the description below. Other features, objects, and advantages will be apparent from the description and drawings, and from the claims.

DETAILED DESCRIPTION

Figure 1:
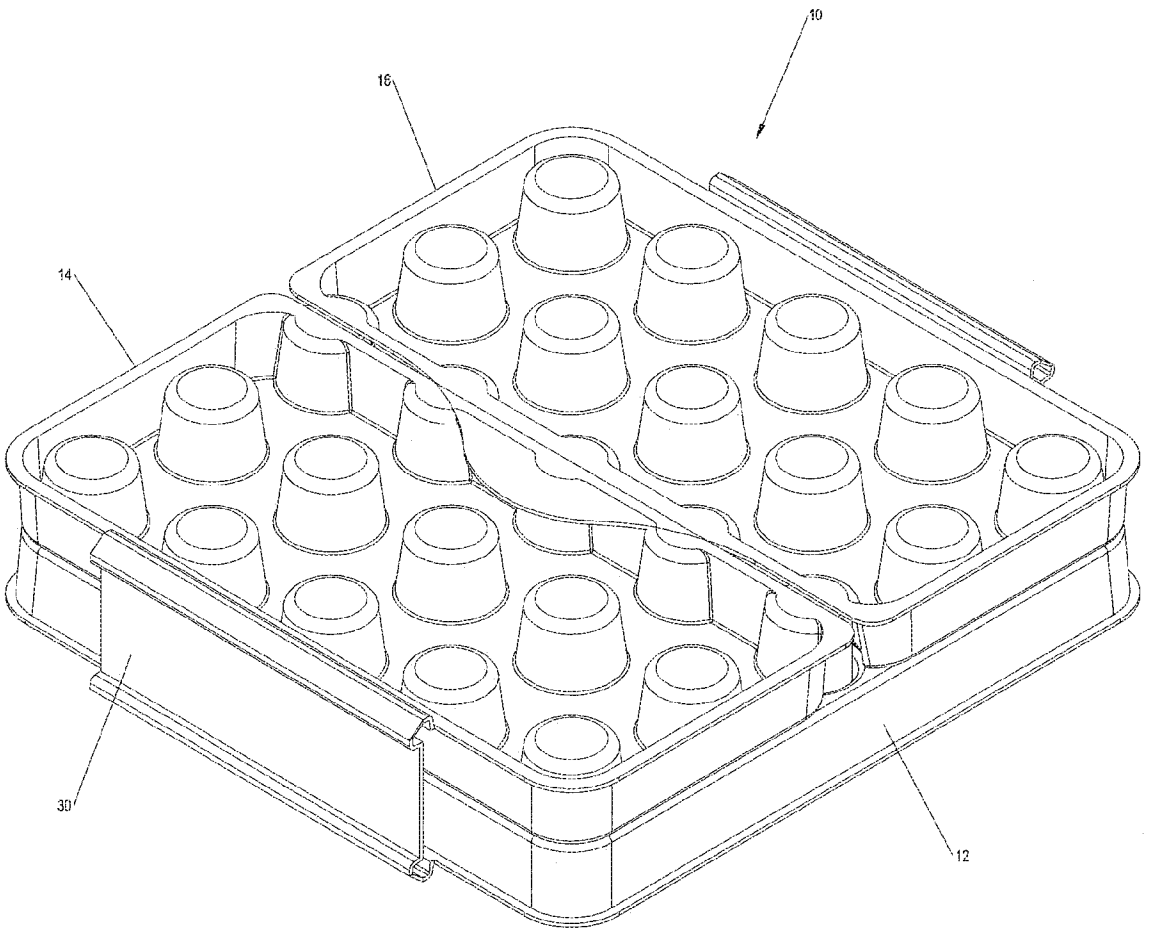
FIG. 1 is a perspective view of one embodiment of a container in a closed position.
Figure 2:
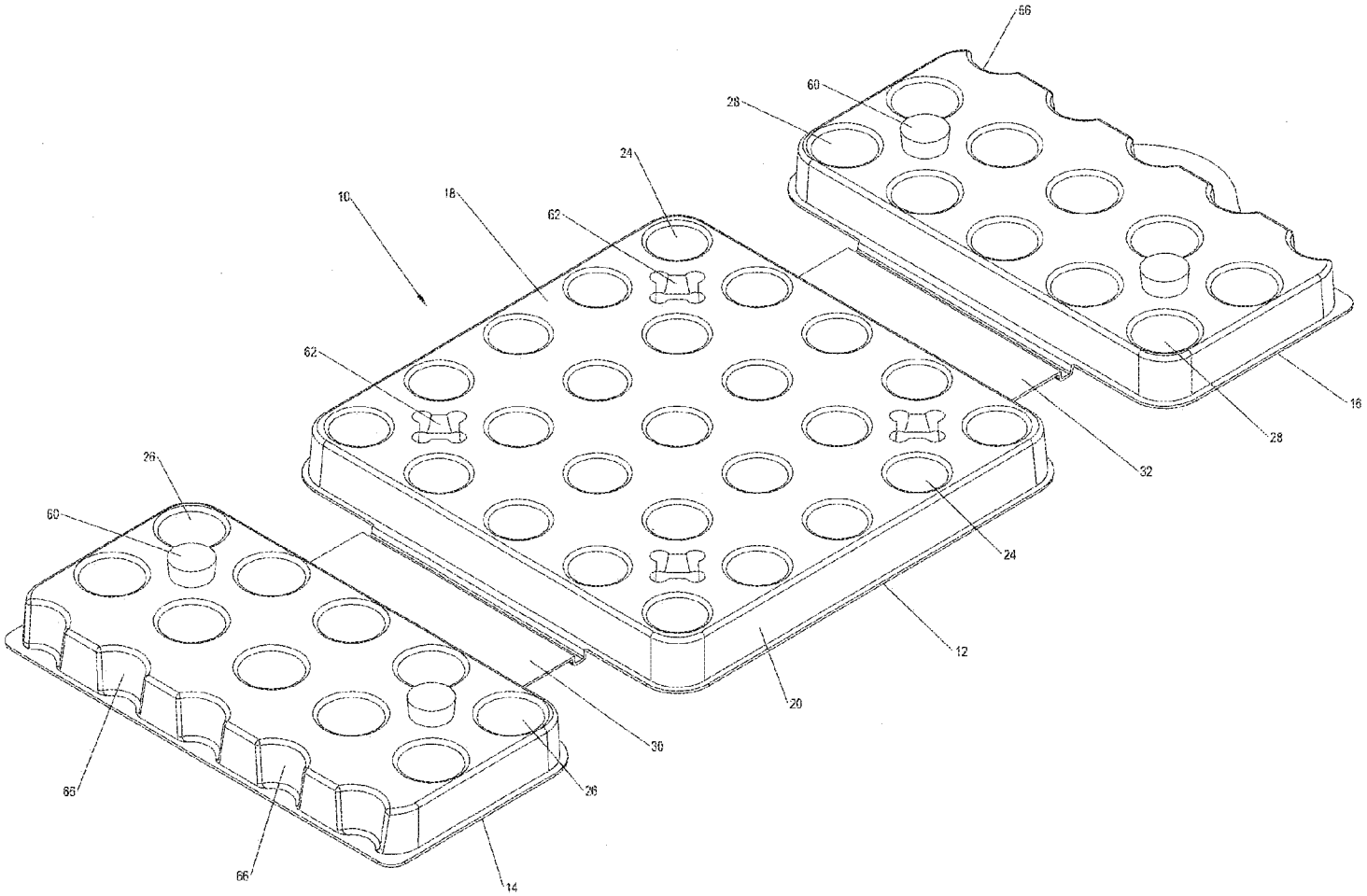
FIG. 2 is a perspective view of the container of FIG. 1 in an open position.
Figure 3:
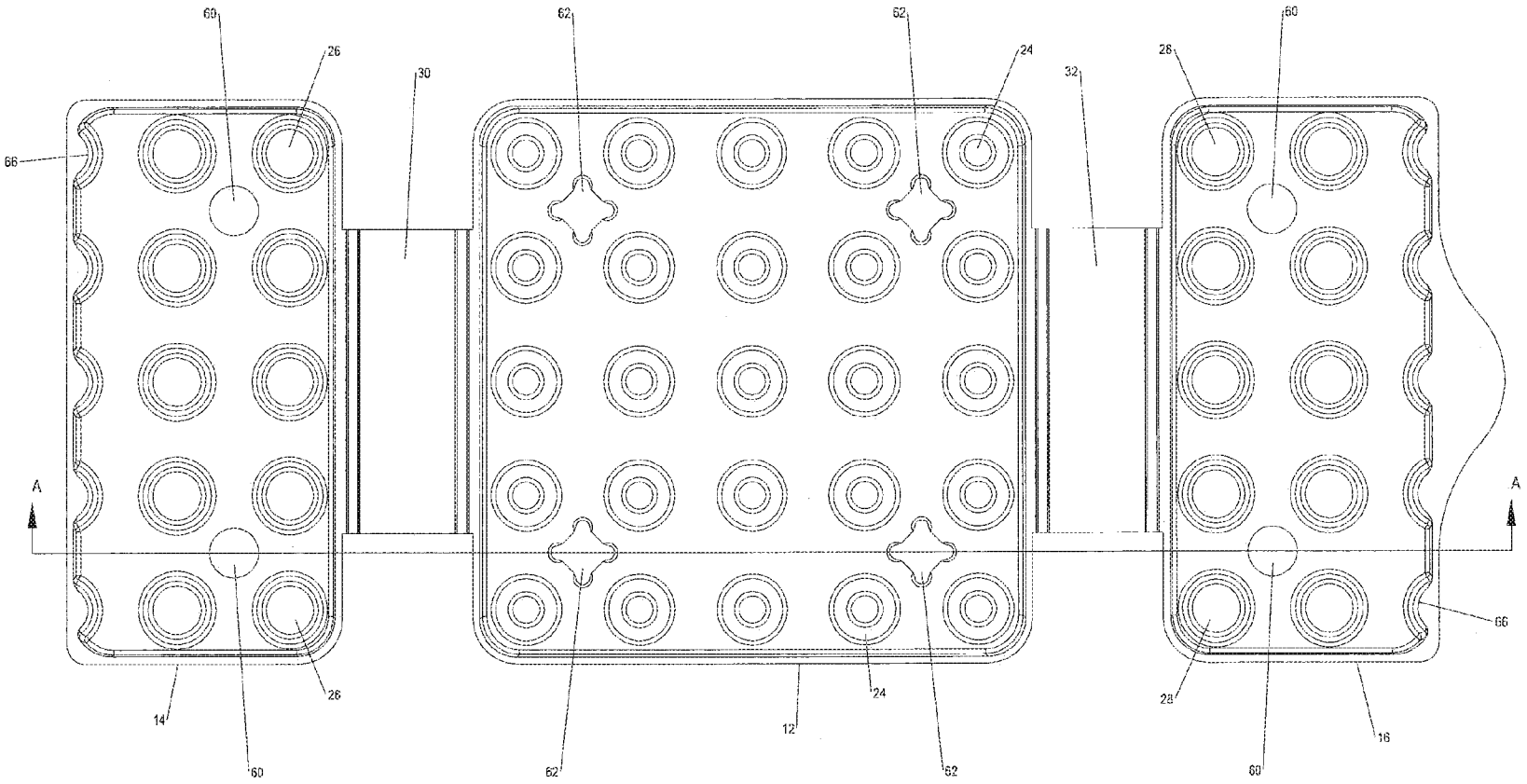
FIG. 3 is a top view of the container of FIG. 2.
Figure 4:
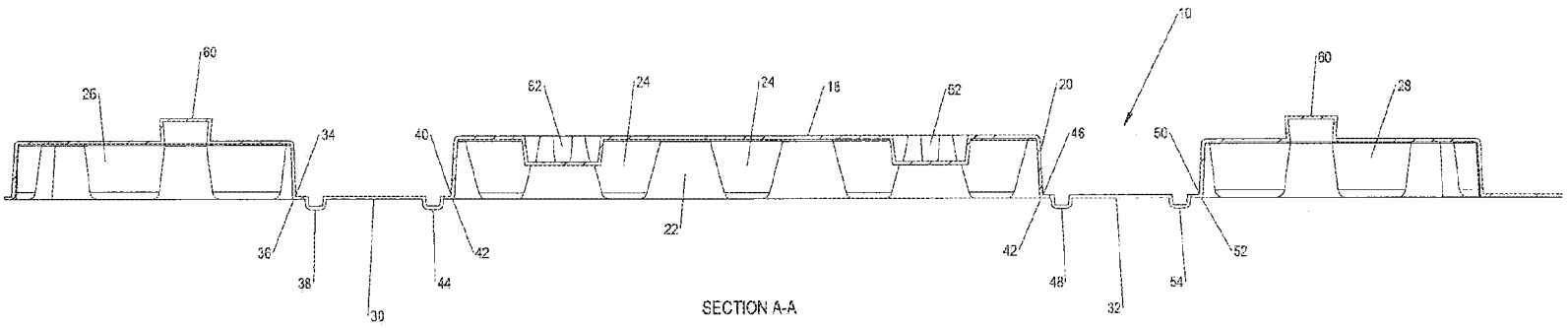
FIG. 4 is a cross-sectional view along line A-A of FIG. 3.

Referring to FIGS. 1-6, a container 10 for storing a plurality of items, such as firearm cartridges, includes a base 12, which may also be referred to as a middle segment, a first cover portion 14, which may also be referred to as a first end segment, and a second cover portion 16, which may also be referred to as a second end segment. As best seen in FIGS. 2 and 4, the base 12, according to one embodiment, includes an upper surface 18 and a side wall 20 extending downwardly from the perimeter of the upper surface to define an interior space 22 below the upper surface. The upper surface 18 may include a plurality of recesses 24 that extend into the interior space as best seen in FIG. 4. These recesses may be the same size or different sizes and may be configured to hold a variety of different items. In one embodiment, the base 12 includes twenty-five recesses that are each shaped and sized to hold the tip of a .38 caliber cartridge or other size ammunition. Of course, in other embodiments the base 12 may include a different number of recesses, which may be arranged in any fashion.

Still referring to FIGS. 2 and 4, the first cover portion 14 and second cover portion 16 may be constructed similarly to the base 12 with an upper surface and a side wall extending downwardly from the perimeter of the upper surface to define an interior space below the upper surface. As used herein, "upper" refers the position of the surface when the container is in the fully open position, as shown in FIG. 2, even though the first and second cover portions 14, 16 may be moved into other orientations as shown in FIG. 1.

A plurality of recesses 26 may be located in the upper surface of the first cover portion 14 and a plurality of recesses 28 may be located in the upper surface of the second cover portion 16. These recesses 26, 28 may be shaped the same or differently than the recesses 24 in the base 12 and may be configured to align with the recesses 24 in the base to cooperatively define a plurality of hollow spaces that surround an item to be stored, such as a 9 mm caliber cartridge. So, for example, the recesses 24 in the base may be shaped to receive the tip of a cartridge, while the recesses 26, 28 in the first and second cover portions 14, 16 may be shaped to receive the rim or base of the cartridge case.

Figure 5:
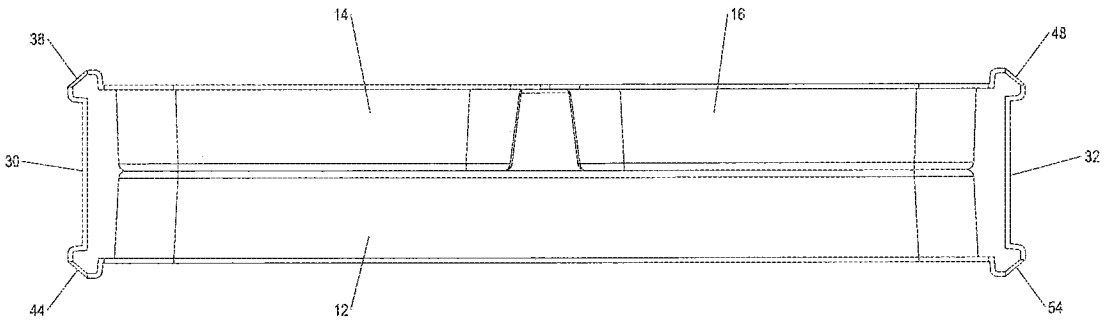
FIG. 5 is a side view of the container of FIG. 1.

Referring to FIGS. 2-5, a first link 30 connects the base 12 to the first cover portion 14 and a second link 32 connects the base 12 to the second cover portion 16. The first link 30 has a first end 34 that is pivotably connected to the first cover portion 14. The connection may be at the bottom side 36 of the first cover portion 14 and may be by means of a first flexible hinge 38. A second end 40 of the first link 30 is pivotably connected to the base 12. This connection may be at the bottom side 42 of the base 12 and may be by means of a second flexible hinge 44. The second link 32 has a first end 46 that is pivotably connected to the base 12. This connection may be at the bottom side 42 of the base 12 and may be by means of a third flexible hinge 48. A second end 50 of the second link 32 is pivotably connected to the second cover portion 16. This connection may be at the bottom side 52 of the second cover portion 16 and may be by means of a fourth flexible hinge 54. As best seen in FIG. 5, the length of the first link 30 may be substantially equal to the combined height of the base 12 and the first cover portion 14. Similarly, the length of the second link 32 may be substantially equal to the combined height of the base 12 and the first cover portion 14.

Referring to FIGS. 1,2, and 5, the container 10 is movable between a fully open position, as shown in FIG. 2, and a closed position, shown in FIG. 1. In the fully open position the first and second cover portions 14, 16 are pivoted away from the base 12 to expose the recesses 24 in the base. Of course, just one of the first or second cover portions 14, 16 could be pivoted away from the base 12 in a partially open position. In the fully open position shown in FIG. 4, the first and second cover portions 14, 16 may lay flat such that the bottom side 42 of the base, the bottom side 36 of the first cover portion, the bottom side 52 of the second cover portion, the first link 30 and the second link 32 all lie in substantially the same plane. This is the position that the container may be formed in before being folded into a container. As used herein, the fully open container may also be referred to as a tray.

As seen in FIGS. 1 and 5, the first and second cover portions 14, 16 may be pivoted over the base 12 such that the upper surfaces of the first and second cover portions 14, 16 face and are adjacent to the upper surface 18 of the base 12. In this position the recesses 24 in the base are not accessible and the recesses 26, 28 in the first and second cover portions 14, 16 may align with the recesses 24 in the base 12 to form a plurality of hollow spaces. As best seen in FIG. 5, according to one embodiment, when the container is in the closed position, the first and second cover portions 14, 16 present a substantially flat surface, at least at their perimeter side walls, such that multiple containers can be stacked on one another. In the embodiment that is shown, the first and second cover portions 14, 16 are both approximately the same width, which is approximately half the width of the base 12. Of course, the first and second cover portions 14, 16 could be different sizes as long as, when both are pivoted to the closed position, they cooperatively cover the items to be stored in the base.

To secure the contents of the container and retain the first and second cover portions 14, 16 in the closed position, one or more snap features may be formed on the tray. Referring to FIGS. 2 and 4, in one embodiment the snaps may comprise a male snap member 60 and a female snap member 62 that is sized to receive and retain the male snap member. As best seen in FIG. 4, the male snap member 60 may be an upstanding post with diameter that is largest at its upper end. As seen in FIGS. 3 and 4, the female snap member 62 may be a recess with inwardly projecting detents that are urged out of the way as the male snap member 60 is inserted and then snap back to grip the male snap member 60 once it is fully inserted. Of course other snap configurations are possible and contemplated within the scope of this invention. In the pictured embodiment, male snap members 60 are positioned on the upper surfaces of the first and second cover portions 14, 16, while female snap members are positioned on the upper surface 18 of the base 12. Of course it is also possible for the male snap members to be located on the base and for the female snap members to be located on one or more of the cover portions in any combination. Additionally, in the pictured embodiment, both cover portions are secured to the base using two snaps. However, one or more snaps could be used depending on the size of the tray or the holding strength of each snap.

Figure 6:
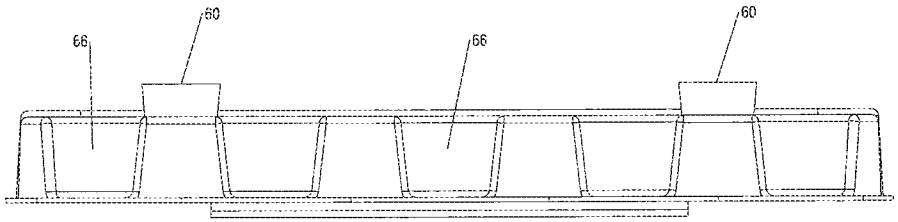
FIG. 6 is an end view of the container of FIG. 2 in an open position.

Referring now to FIGS. 2, 3, and 6, according to a particular embodiment, the outer side walls of the first and second cover portions 14, 16 may include one or more indentations 66 that align in the closed position to cooperatively define one or more hollow spaces to surround an item. In the embodiment shown in FIGS. 1 and 2, the base 12 includes 5 rows of recesses and each of the first and second cover portions 14, 16 includes two full rows of recesses. When the cover portions 14, 16 are moved to the closed position, the indentations 66 on the side walls of the first and second cover portions align to form another row of recess that also align with a row of recesses in the base 12.

The containers 10 may be manufactured in the open position by any known technique. Preferably, a thin sheet of plastic is thermoformed or vacuum formed into a tray that is foldable into the closed container 10. In this manner, the entire container 10 may be integrally formed from a single piece of material. The material used may be any suitable plastic, including a clear or translucent plastic so that the contents of the container can be seen without having to open the container. In particular, the trays may be made from PET, PVC, or any similar thin gauge plastic.

Figure 7:
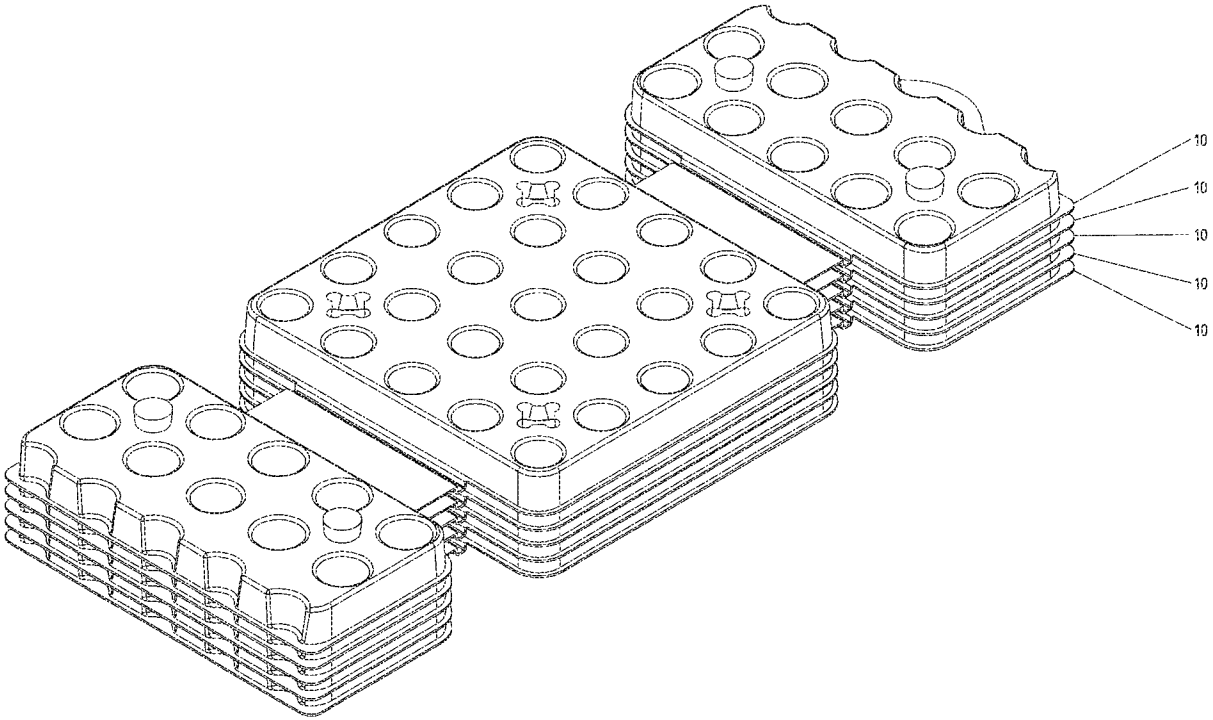
FIG. 7 is a perspective view of a plurality of containers, like the one shown in FIG. 2, nested and stacked on top of one another.

According to another aspect of the invention, the trays are designed to nest within one another for easy and compact stacking, as depicted in FIG. 7. In particular, the top and bottom surfaces of each tray may be formed with cooperative sloped surfaces such that the top surface of one tray substantially fits within the bottom surface of another tray.

As will be appreciated by a person of skill in the art, the disclosed embodiments provide numerous features and benefits over the prior art. The disclosed container is compact, reusable, and yet sturdy enough to protect a plurality of items including ammunition cartridges. Preferably, according to some embodiments, the container can be formed inexpensively from a single thin sheet of material and can be easily stacked when closed. Additionally, according to some embodiments, the container is designed to be nested and stacked when in its open position for efficient storage and shipping.

It is to be clearly understood that the above description is intended by way of illustration and example only, is not intended to be taken by way of limitation, and that other changes and modifications are possible.

What is claimed is:

1. An ammunition storage container comprising:

a base having a plurality of recesses configured to receive an item for storage;

a first cover portion;

a second cover portion;

a first link pivotably connected to the base and pivotably connected to the first cover portion;

a second link pivotably connected to the base and pivotably connect to the second cover portion;

a first snap comprising a male snap member located on one of the base or the first cover portion and a female snap member located on the other one of the base or the first cover portion; and a second snap comprising a male snap member located on one of the base or the second cover portion and a female snap member located on the other one of the base or the second cover portion;

wherein the first cover portion and the second cover portion both include a plurality of recesses configured to receive an item for storage;

wherein the container is moveable between an open position and a closed position;

wherein in the open position the first cover portion and second cover portion are pivoted away from the base to expose the recesses in the base;

wherein in the closed position the first cover portion and the second cover portion are pivoted over the base such that the male and female snap members of the first snap engage and the male and female snap members of the second snap engage;

wherein in the closed position a plurality of recesses in the first cover portion align with a first multiplicity of the plurality of recesses in the base to cooperatively define a plurality of hollow spaces configured to surround an item for storage;

wherein the first cover portion includes a side wall having indentations, wherein the second cover portion includes a side wall having indentations, and wherein in the closed position a plurality of indentations in the side wall of the first cover portion align with a plurality of indentations in the side wall of the second cover portion and with a second multiplicity of the plurality of recesses in the base to cooperatively define another plurality of hollow spaces configured to surround an item for storage.

2. The container of claim 1, wherein the base, first cover portion, second cover portion, first link, second link, first snap, and second snap are integrally formed from a single piece of material.

3. The container of claim 2, wherein the first link is pivotably connected on a first side to the base by a first flexible hinge and is pivotably connected on a second side to the first cover portion by a second flexible hinge.

4. The container of claim 1, wherein the base comprises an upper surface and a side wall extending downwardly from the perimeter of the upper surface, wherein the upper surface and the side wall define an interior space below the upper surface, and wherein the plurality of recesses in the base are located on the upper surface and extend into the interior space.

5. The container of claim 1, wherein the item for storage is a cartridge.

6. A plastic tray configured to be folded into a container, the tray comprising:

a first end segment having a bottom side and a top side, the top side including a plurality of recesses therein;

a first link having a first end and second end, the first end pivotably connected to the first end segment;

a middle segment pivotably connected to the second end of the first link, the middle segment having a bottom side and a top side, the top side including a plurality of recesses therein;

a second link having a first end and second end, the first end pivotably connected to the middle segment; and a second end segment pivotably connected to the second end of the second link, the second end segment having a bottom side and a top side, the top side including a plurality of recesses therein;

wherein the first end segment and second end segment are pivotable to a closed position over the middle segment such that the top sides of the first and second end segments face and are adjacent to the top side of the middle segment, and in the closed position at least some of the plurality of recesses of the first end segment align with a first multiplicity of the plurality of recesses of the middle segment to cooperatively define a first plurality of hollow spaces for item storage;

wherein the first end segment includes a side wall having indentations, wherein the second end segment includes a side wall having indentations, and wherein in the closed position a plurality of indentations in the side wall of the first end segment align with a plurality of indentations in the side wall of the second segment and with a second multiplicity of the plurality of recesses in the middle segment to cooperatively define a second plurality of hollow spaces for item storage.

7. The plastic tray of claim 6, wherein the first end of the first link is pivotably connected to the bottom side of the first end segment, wherein the second end of the first link is pivotably connected to the bottom side of the middle segment, wherein the first end of the second link is pivotably connected to the bottom side of the middle segment, wherein the second end of the second link is pivotably connected to the bottom side of the second end segment, and wherein the bottom side of the first end segment, the first link, the bottom side of the middle segment, the second link, and the bottom side of the second end segment all lie in substantially the same plane.

8. The plastic tray of claim 6, wherein the top side of the first end segment includes a first snap member and the top side of the middle segment includes a second snap member configured to engage the first snap member and releasably retain the first end segment over the middle segment.

9. The plastic tray of claim 8, wherein the top side of the second end segment includes a third snap member and the top side of the middle segment includes a fourth snap member configured to engage the third snap member and releasably retain the second end segment over the middle segment.

10. The plastic tray of claim 6, wherein the length of the first link between its first and second ends is substantially equal to the combined height of the middle segment between its top and bottom sides and the height of the first end segment between its top and bottom sides.

11. The plastic tray of claim 6, wherein the plurality of recesses in the middle segment are configured to receive a firearm cartridge.

12. The plastic tray of claim 6, wherein the tray has a top surface and a bottom surface that are configured such that the tray will nest within an identical tray when the trays are stacked.

* * * * *